US010040611B2

(12) United States Patent
Nelson

(10) Patent No.: US 10,040,611 B2
(45) Date of Patent: Aug. 7, 2018

(54) METHOD OF MANUFACTURING A LOCK-BOX

(71) Applicant: Safemark Systems, LP, Orlando, FL (US)

(72) Inventor: Scott Nelson, Apopka, FL (US)

(73) Assignee: Safemark Systems, LP, Orlando, FL (US)

( * ) Notice: Subject to any disclaimer, the term of this patent is extended or adjusted under 35 U.S.C. 154(b) by 0 days.

(21) Appl. No.: 15/894,596

(22) Filed: Feb. 12, 2018

(65) Prior Publication Data

US 2018/0162613 A1 Jun. 14, 2018

Related U.S. Application Data

(62) Division of application No. 14/586,822, filed on Dec. 30, 2014, now Pat. No. 9,889,979.

(51) Int. Cl.

| | |
|---|---|
| ***B65D 55/14*** | (2006.01) |
| ***E05B 17/10*** | (2006.01) |
| ***E05B 47/02*** | (2006.01) |
| ***E05B 65/00*** | (2006.01) |
| ***E05G 1/00*** | (2006.01) |
| *E05G 1/04* | (2006.01) |
| *E05B 17/22* | (2006.01) |
| *E05B 47/00* | (2006.01) |

(52) U.S. Cl.

CPC ..... *B65D 55/14* (2013.01); *E05B 17/10* (2013.01); *E05B 47/026* (2013.01); *E05B 65/0075* (2013.01); *E05G 1/005* (2013.01); *E05B 17/226* (2013.01); *E05B 47/0038* (2013.01); *E05B 2047/0086* (2013.01); *E05G 1/04* (2013.01)

(58) Field of Classification Search

CPC ..... B65D 55/14; E05B 17/10; E05B 47/026; E05B 65/0075; E05B 17/226; E05B 47/0038; E05B 2047/0086; E05G 1/005; E05G 1/04; G07C 9/00563; G07C 9/0069; G07C 9/00912

USPC ..... 340/5.73, 5.54, 5.52; 70/278.7

See application file for complete search history.

(56) References Cited

U.S. PATENT DOCUMENTS

| | | | | |
|---|---|---|---|---|
| 3,878,511 | A | 4/1975 | Wagner | |
| 4,887,445 | A | 12/1989 | Beatty | |
| 5,349,345 | A | 9/1994 | Vanderschel | |
| 8,256,917 | B2 * | 9/2012 | Gammell | E05B 17/10 362/100 |
| 8,789,884 | B1 | 7/2014 | Edelman et al. | |

(Continued)

*Primary Examiner* — Ali Neyzari

(74) *Attorney, Agent, or Firm* — Dentons US LLP

(57) ABSTRACT

A method of manufacturing a lock-box may include assembling top, bottom, left, right, and rear walls. A front door may be assembled with an electromechanical lock assembly mounted thereto, and be rotatably secured to a wall. A user interface may be electrically connected to the electromechanical lock assembly, and accessible to a user at the front face of the lock-box. An illumination device may be electrically connected to electronics of the electromechanical lock assembly. A backlit panel may be removably attached to the front door to form a portion of a front face of the front door, where the backlit panel is positioned in front of the illumination device so that information on the backlit panel is illuminated when the illumination device is illuminated. A latch member may be secured within the lock-box to secure the front door when in a closed position.

15 Claims, 5 Drawing Sheets

(56) References Cited

U.S. PATENT DOCUMENTS

| | | | | |
|---|---|---|---|---|
| 9,327,887 | B2 | 5/2016 | Farentinos | |
| 9,889,979 | B2 * | 2/2018 | Nelson | B65D 55/14 |
| 2009/0108988 | A1 | 4/2009 | Cleveland et al. | |
| 2010/0271808 | A1 | 10/2010 | Gammell | |
| 2011/0276609 | A1 | 11/2011 | Denison | |
| 2016/0053526 | A1 | 2/2016 | Dittrich | |

* cited by examiner

METHOD OF MANUFACTURING A LOCK-BOX

RELATED APPLICATIONS

This Application is a division of U.S. application Ser. No. 14/586,822, filed Dec. 30, 2014, entitled SYSTEM AND METHOD FOR CONTROLLING LOCK-BOX WITH BACKLIT FRONT PANEL, now U.S. Pat. No. 9,889,979, the contents of which are hereby incorporated by reference in their entirety.

BACKGROUND

Hotel safes or lock-boxes that are typically positioned in closets have long been used to enable hotel guests to lock their valuables within the safes for security purposes. These safes typically have a keypad via which a user enters a 4-digit security code to lock and unlock the lock-boxes. Historically, the lock-boxes have been basic in their design, where a lock-box has been configured with a door on which a keypad and lock mechanism are fixedly attached to operate as a user interface. While such lock-boxes have been functionally operational, the lock-boxes have had limitations when positioned in closets as minimal lighting often makes it difficult for a user to read instructions typically stickered on the front door. Moreover, programming or reprogramming a lock has typically required disassembly of the front door, typically through an inside wall that includes fastening members (e.g., screws), thereby making such programming and reprogramming time consuming.

SUMMARY

In order to assist hotel guests and other users with operation of a lock-box often used within hotel rooms, a lock-box with a front door having one or more backlit panels that are backlit to provide illuminated instructions for a time period may be provided. The backlit panel(s) may be configured utilizing a standoff member and magnets to maintain position of the backlit panel(s) with respect to the front door. To expedite servicing of the lock-box, a magnetic key may be utilized to facilitate removal of the backlit panel(s) that are magnetically being held in place on the front door. Behind the backlit panel(s), an override key cover may be disposed over an override lock mechanism available to override the electromechanical lock assembly in the event the electromechanical lock assembly is locked and cannot be opened using the keypad. In operation, in response to a user interfacing with a key of a keypad used to lock and unlock an electromagnetic lock of the lock-box, electronics may cause an illumination device to turn ON for a predetermined period of time and turn OFF thereafter.

One embodiment of a lock-box may include a set of walls defining a compartment, an electromechanical lock assembly, and a door rotatably coupled to the set of walls that, when in a closed position, forms a fully enclosed lock-box, the door including a front side that includes a user interface in communication with the electromechanical lock assembly, and by which a user interfaces to lock and unlock the door. The front side of the door further includes a panel configured to be backlit and an illumination device configured to backlight the panel.

One embodiment of a method of controlling a lock-box may include receiving a user interface signal in response to a user engaging a user interface of the lock-box, and causing an illumination device to illuminate and backlight a panel disposed on a front face of a front door of the lock-box.

One embodiment of a method of manufacturing a lock-box may include assembling a lock-box, including top, bottom, left, right, and rear walls. A front door may be assembled. In assembling the front door, an electromechanical lock assembly may be mounted to the front door. A user interface may be electrically connected to the electromechanical lock assembly. The user interface may be secured to be accessible to a user at the front face of the lock-box. An illumination device may be electrically connected to electronics of the electromechanical lock assembly. A backlit panel may be removably attached to the front door to form a portion of a front face of the front door, where the backlit panel is positioned in front of the illumination device so that information on the backlit panel is illuminated for a user when the illumination device is illuminated. A latch member may be secured within the lock-box such that one or more movable bolts of the electromechanical lock assembly are aligned to enter and be removably engaged with the latch member when the front door is a closed position. The front door may be rotatably secured to the lock-box to enable the front door to rotate relative to the lock-box such that the one or more movable bolts of the electromechanical lock assembly are aligned to enter and be removably engaged with the latch member when the front door is in the closed position.

One embodiment of a lock-box may include a set of walls defining a compartment, an electromechanical lock assembly, and a door rotatably coupled to the set of walls that, when in a closed position, forms a fully enclosed lock-box. The door may include a front face that includes (i) a user interface in communication with said electromechanical lock assembly, and by which a user interfaces to lock and unlock the door, (ii) a cavity defined by the door, and (iii) a panel configured to be positioned over the cavity in which at least a portion of an electromechanical lock assembly is accessible, and to form a portion of the front face of the door. The panel further being configured to be detachable from the door.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION OF THE DRAWINGS

Figure 1:
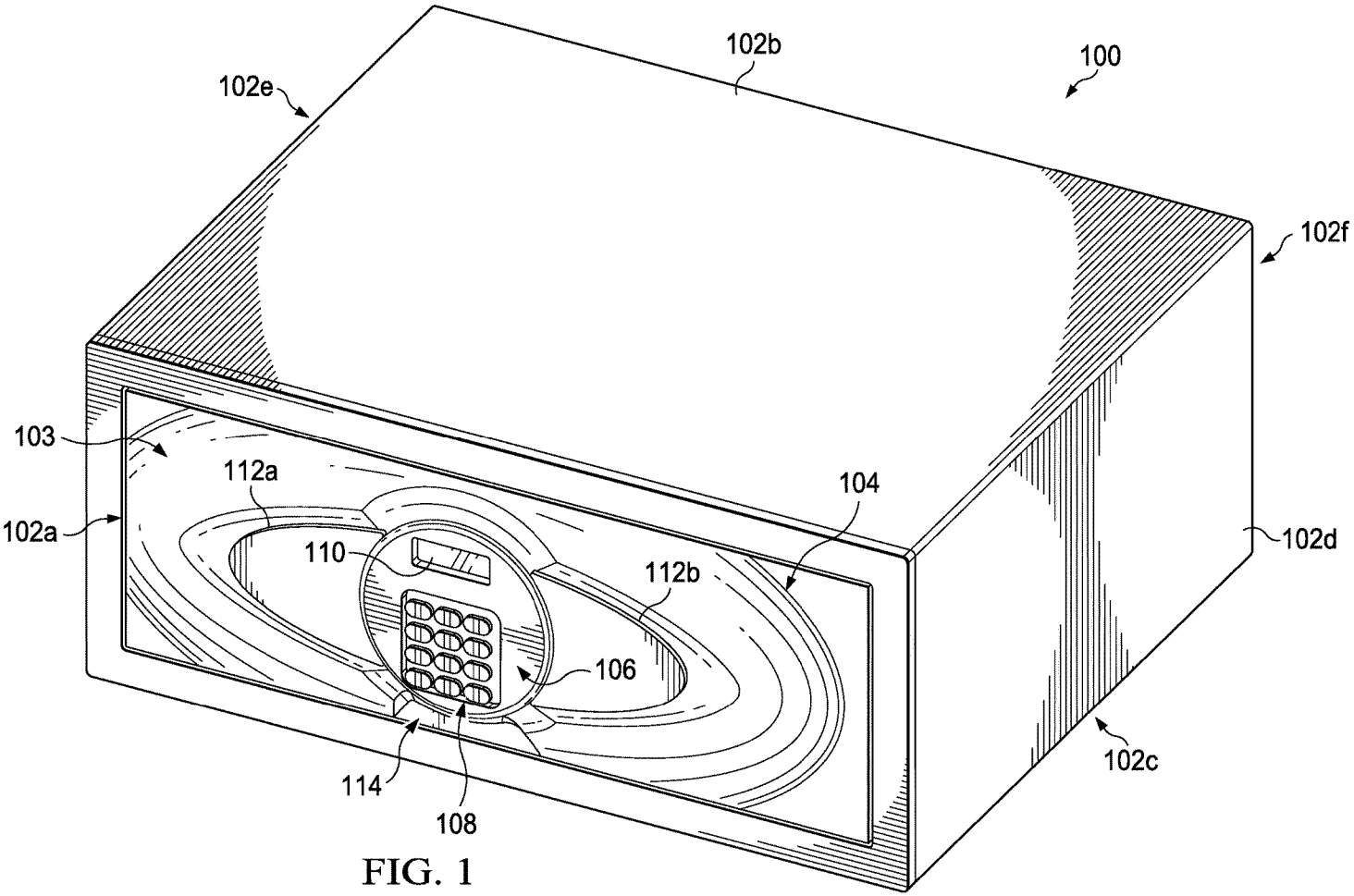
FIG. 1 is an illustration of a door of a lock-box, typically used within a hotel room, utilized to provide a user with a user interface that enables a user to lock and unlock the lock-box.

With regard to FIG. 1, an illustration of a lock-box 100, typically used within a hotel room is shown. The lock-box 100 includes a front door 102*a*, top wall 102*b*, bottom wall 102*c*, right wall 102*d*, left wall 102*e*, and rear wall 102*f* (collectively walls 102). The front door 102*a* includes a front face 103 that may include a three-dimensional (3D) ornamental feature 104, such as a smooth protrusion having an oval or other shape. The front door 102*a* may be configured to provide a user with a user interface 106 that enables a user to lock and unlock the lock-box 100. The user interface 106 may include a user interface mechanism 108, such as a keypad or other mechanism (e.g., card reader, image sensor to read an image, such as a QR code or barcode, or other electronic device), and a display 110 that may display information, such as a numbers being entered, status messages for users and operators, etc.

The front door 102*a* may also include one or more panels 112*a* and 112*b* (collectively 112) that are backlit (also referred to as backlit panels) that may be lit up to display a logo, instructions, or other information to a user who is operating the lock-box 100. For example, the instructions may include step-by-step instructions for locking and unlocking the lock-box via the user interface. Because the panels 112 are backlit, the instructions can be read more easily as compared to printed instructions when the lock-box 100 is positioned in a dark location, such as a closet of a hotel room, which is often the case with this type of lock-box 100. And, because the information is static, the use of backlit panels is inexpensive as compared with liquid crystal (LCD) or other types of display. The panels 112 cover compartments (see FIGS. 2-4) in which the features of an electromechanical lock may be accessed to make servicing of the lock-box 100 fast and easy as compared with conventional lock-boxes.

Figure 2:
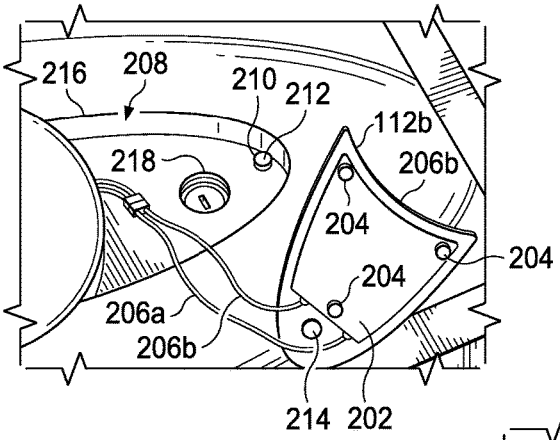
FIG. 2 is an illustration of an illustrative backlit panel being detached from the front door of the lock-box and showing a compartment behind the detached front panel.

With regard to FIG. 2, an illustration of an illustrative backlit panel 112*b* being detached from the front door 102*a* of the lock-box 100 of FIG. 1 is shown. The backlit panel 112*b* is shown to have been detached from the front door 102*a*. Attached to the back of the backlit panel 112*b* is an illumination device 202 that is secured to the backlit panel 112*b* via fastening members 204, in this case screws. The illumination device 202 may be an LED panel, as shown, where a pair of wires 206*a* and 206*b* may extend from electronics of an electromechanical lock assembly (not shown) used to lock and unlock the front door 102*a* of the lock-box 100. It should be understood that any illumination device, such as a incandescent light bulb, single point LEDs, or any other illumination device may be disposed within compartment or cavity 208 defined by the front door 102*a* and backlit panel 112*b*.

Additionally shown within the cavity 208 is a standoff member 210 on which a permanent magnet 212 is affixed (e.g., glued), where the standoff 210 is used to support the magnet 212 so that an opposing permanent magnet 214 affixed to the backlit panel 112*b* may magnetically secure the backlit panel 112*b* to the front door 102*a*. A ridge 216 extending within a perimeter of the cavity 208 supports the backlit panel 112*b* thereon, such that the backlit panel 112*b* is flush with the front face of the front door 102*a* to make a better looking front door 102*a*, to conceal from a user that the backlit panel 112*b* is detachable or removable from the front face of the front door 102*a*, and to make it more difficult for someone to recognize that the cavity 208 exists. To remove the backlit panel 112*b* when magnetically secured to the front door 102*a* via magnets 212 and 214, a permanent magnet (not shown) with a similar appearance to a key with a magnet on a tip of the key may be magnetically attracted to the affixed side of the magnet 214 stronger than the magnet 212 so as to enable an operator to easily detach the backlit panel 112*b* from the front door 102*a*. A keyhole 218 that is part of a cylinder lock (not shown) as part of the electromagnetic lock assembly provides for an operator to override the electromagnetic lock assembly by which a user controls via the user interface mechanism 108. In one embodiment, a cover (not shown) may be screwed into a bottom surface within the cavity 208 and above the keyhole 218, where the cover may further obscure the keyhole 218 from an unauthorized operator. In one embodiment, the front face of the front door may be coated with a hydroformed graphic that enables specific designs to be coated onto the front face. Other coatings, such as paint, may be utilized, as well, but in some cases, do not provide as distinctive a lock-box as the hydroforming coating. Moreover, the front door may be substantially symmetric such that either a left or right door opening may be used without impacting user experience or functionality.

Figure 3:
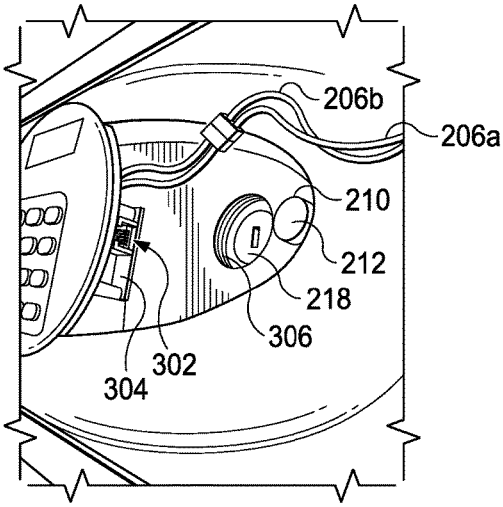
FIG. 3 is an illustration of a close-up view of an illustrative keyhole of an override lock mechanism and electrical connector that provides electrical communication to an electromechanical lock assembly disposed within the compartment behind the backlit panel of FIG. 2.

With regard to FIG. 3, an illustration of a close-up view of the keyhole 218 of an override lock mechanism (see FIG. 4) and electrical connector 302 that provides electrical communication to an electromechanical lock assembly (not shown) disposed behind the backlit front panel 112*b* of FIG. 2 is shown. The electrical connector 302 is in electrical communication with, and may be mounted to, a circuit board 304 on which electronics of the electromechanical lock assembly that control the electromechanical lock assembly are mounted. Threads 306 that are formed within a cylinder into which the override lock assembly 402 (FIG. 4) with the keyhole 218 extends may be used by a cover (not shown) that conceals the keyhole 218 are shown. The cover may have an indentation used to rotate the cover so as to enable an assembler or operator to screw and unscrew the cover along the threads 306. An operator may connect a portable computing device to the connector to update software, such as functionality, of the electromagnetic lock assembly, collect operational data stored by the electromagnetic lock assembly, or otherwise.

Figure 4:
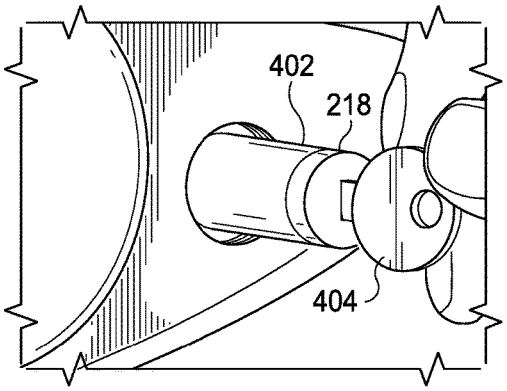
FIG. 4 is an illustration of the override lock mechanism being removed for overriding the electromechanical lock assembly.

With regard to FIG. 4, an illustration of the override lock mechanism 402 being removed for overriding an electromechanical lock assembly that controls locking and unlocking the lock-box 100 (FIG. 1) is shown. A key 404 may extend into the keyhole 218 to rotate a lock mechanism within the override lock mechanism 402 so as to remove the mechanism 402 from the electromechanical lock assembly, thereby overriding the electromechanical lock assembly either in an unlocked or locked state. In one embodiment, two keys may be used to operate the override lock mechanism 402, including a first key that is operable when the electromechanical lock assembly is in an unlocked state and a second key that is operable when the electromechanical lock assembly is in a locked state so that only select authorized operators are able to override the electromechanical lock assembly when a user has locked personal items in the lock-box 100.

Figure 5:
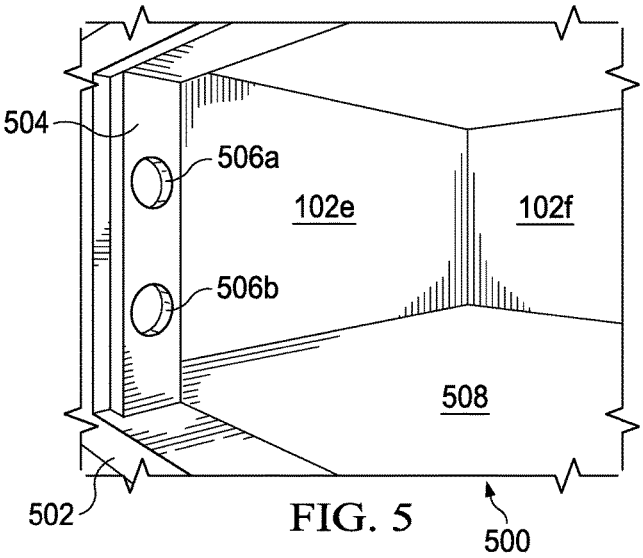
FIG. 5 is an illustration of the lock-box with a compartment defined by walls of the lock-box.

With regard to FIG. 5, an illustration of the lock-box 100 with a compartment 500 defined by the walls 102 (FIG. 1) is shown. In one embodiment, the lock-box 100 includes a frame 502 that extends from the left, top, right, and bottom walls 102*e*, 102*b*, 102*d*, and 102*c* to support the front door 102*a* and to provide additional structure to the lock-box 100. The frame may be directly or indirectly coupled to the walls using any attachment means capable of fixedly securing the frame to the walls, including welding, gluing, using hardware, such as screws and/or bolts, or otherwise. An illustrative latch member 504 may be affixed to the frame 502, and extend between the bottom and top of the frame along one edge of the frame 502. As shown, the latch 504 may define openings 506*a* and 506*b* (collectively 506) that are sized and shaped to receive movable bolts or strikers (see FIG. 6) of an electromechanical lock assembly. In this case, the openings 506 are circular, but any other shape and/or size that matches bolts of the electromechanical lock assembly may be utilized. A floor member 508, such as a strip of carpet or other soft material, may be disposed within the compartment 500.

Figure 6:
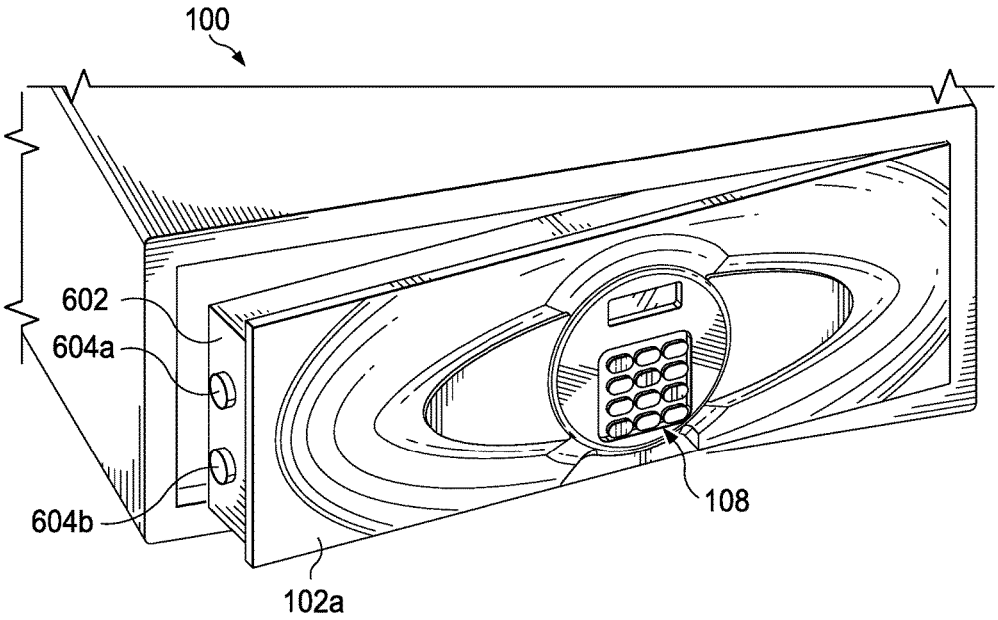
FIG. 6 is an illustration of the front door inclusive of a housing that encloses the electromechanical lock assembly inclusive of illustrative movable bolts.

With regard to FIG. 6, an illustration of the front door 102*a* inclusive of a housing 602 that encloses the electromechanical lock assembly inclusive of illustrative movable bolts 604*a* and 604*b* (collectively 604) is shown. The movable bolts 604 are configured to extend and retract from the housing 602 so as to engage and disengage openings 506 of the latch member 504 of FIG. 5 when the electromechanical lock assembly is respectively locked and unlocked. To lock and unlock the electromechanical lock assembly, a user may utilize the keypad 108 to enter a lock code by pressing four numbers, for example, and a lock button, which causes the movable bolts 604 to extend, and then re-pressing the same four numbers, which causes the movable bolts 604 to retract.

Figure 7A:
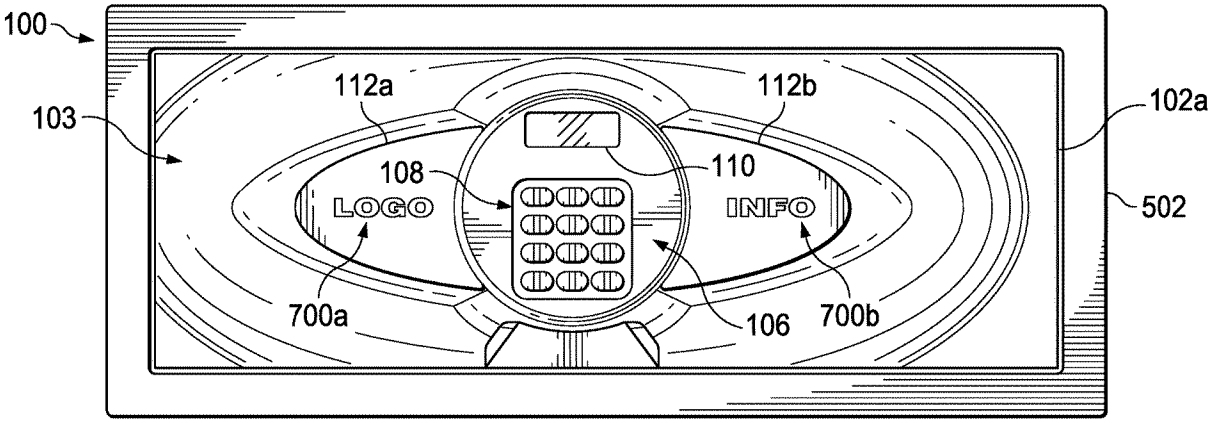
FIGS. 7A and 7B are illustrations of front views of a front face of a front door of the lock-box of FIG. 1 showing a logo and information on backlit panels on the front door that are transitioned from OFF to ON in response to a user interacting with the user interface, such as a keypad.
Figure 7B:
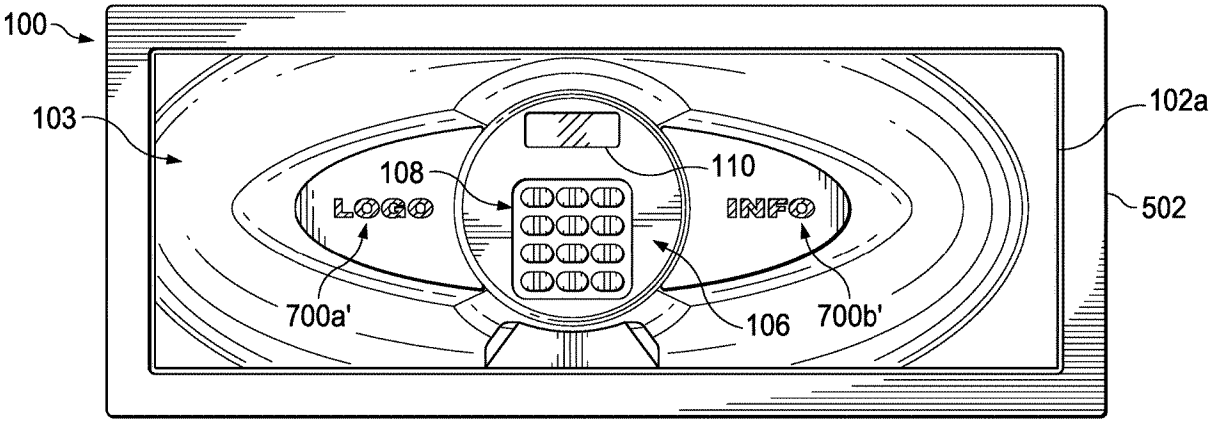

With regard to FIGS. 7A and 7B, illustrations of front views of the front face 103 of the front door 102*a* of the lock-box of FIG. 1 showing a logo 700*a* and information 700*b* on backlit panels 112 on the front door are shown. The backlit panels 112 are transitioned from OFF to ON illumination states in FIGS. 7A and 7B, respectively, in response to a user interacting with the user interface 106, which may include keypad 108 and electronic display 110. For example, in response to a user pressing a button on the keypad 108, illumination device(s), such as illumination device 202 of FIG. 2, are illuminated, thereby causing the logo 700*a* and information 700*b* to illuminate for the user. As understood in the art, the logo 700*a* and information 700*b* are transparent or translucent and, thus, are illuminated by the illumination device(s), while the remainder of the backlit panels 112 are opaque and, thus, do not enable illumination of any non-transparent or translucent regions to be seen by a user. In one embodiment, the information 700*b* are instructions for operating the lock-box 100, and the logo 700*a* may be a name and image associated with a company that produces the lock-box 100. Upon reaching a certain time period, the illumination device(s) used to illuminate the backlit panels 112 may be controlled to be in an OFF state, thereby saving power and preserving operation of the illumination device(s). It should be understood that the logo and information are illustrative, and may be alternatively positioned or include additional and/or alternative content.

As shown in FIG. 7B, the logo 700*a*' and information 700*b*' are illuminated. The illumination may be any color, such as orange, yellow, blue, etc., that are easy to view by a user. In one embodiment, the length of time that the illumination device is lit may be predetermined and performed by electronics and/or software of an electromechanical lock assembly that controls the lock-box 100. For example, in response to a user pressing a key of the keypad 108, software operating on a processing unit may initiate a counter timer (or countdown timer) that causes the illumination device(s) to turn ON and stay ON for a predetermined period of time, such as 30 seconds, whereupon the counter timer (or countdown timer) completing the count, the processor (and/or other electronics) causes the illumination device(s) to turn OFF and stay OFF. In one embodiment, as a user presses additional buttons or otherwise interacts with the user interface 106, the timer may be reset so as to maintain illumination of the illumination device(s) for extended time periods from the first user interaction. In an alternative embodiment, rather than using a counter timer in the processing unit, a one-shot or multi-one-shot electronic timer, as understood in the art, that maintains a signal in an ON value for a predetermined period of time and then transitions the signal to an OFF value may be utilized.

Figure 8:
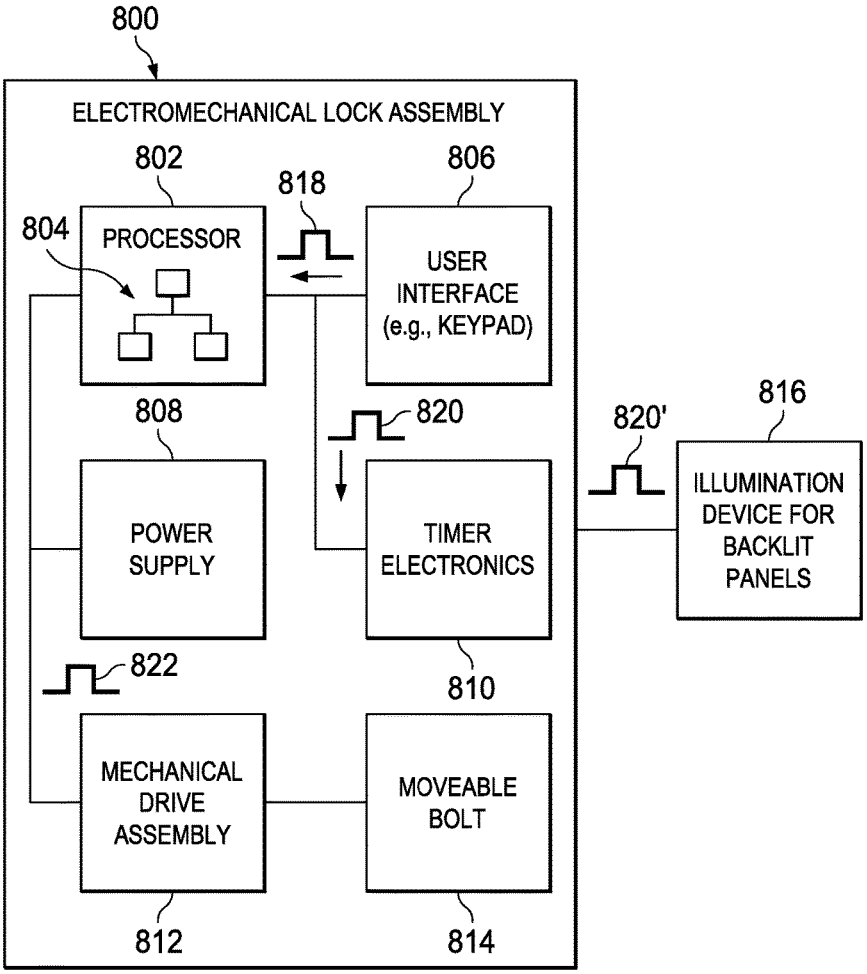
FIG. 8 is an electrical schematic of an illustrative electromechanical lock assembly configured to control operation of a lock-box in response to a user using a user interface of the lock-box.

With regard to FIG. 8, an electrical schematic of an illustrative electromechanical lock assembly 800 configured to control operation of a lock-box in response to a user using a user interface of the lock-box is shown. The electromechanical lock assembly 800 includes a processing unit 802 that executes software 804 configured to control operation of the electromechanical lock assembly 800. The processor 802, may be in communication with a user interface 806, such as a keypad and electronic display, that may enable a user to operate the electromechanical lock assembly 800. The user interface 806 may utilize alternative components, such as a card reader or other non-keypad electronic device. A power supply 808, such as one or more batteries, may be utilized to drive power to electronics and electromechanical components of the assembly 800. In one embodiment, the software 804 being executed by processor 802 may include a timer module. Alternatively, timer electronics 810 may be utilized to create a timer signal. For this description, timer electronics may be considered part of or independent from the processor 802. A mechanical drive assembly 812 may be configured to drive one more movable bolts 814, such as movable bolts 604 of FIG. 6. The mechanical drive assembly 812 may include a motor or any other electromechanical drive mechanism. An illumination device 816 may be in communication with the electromechanical lock assembly 800. If multiple backlit panels are utilized, then multiple illumination devices may be utilized, and one or more illumination devices may be utilized for each backlit panel. If the power supply 808 comes from power lines of a power grid, the illumination device 816 may be continuously ON or ON for longer periods of time as batter life is not a driving factor.

Figure 9:
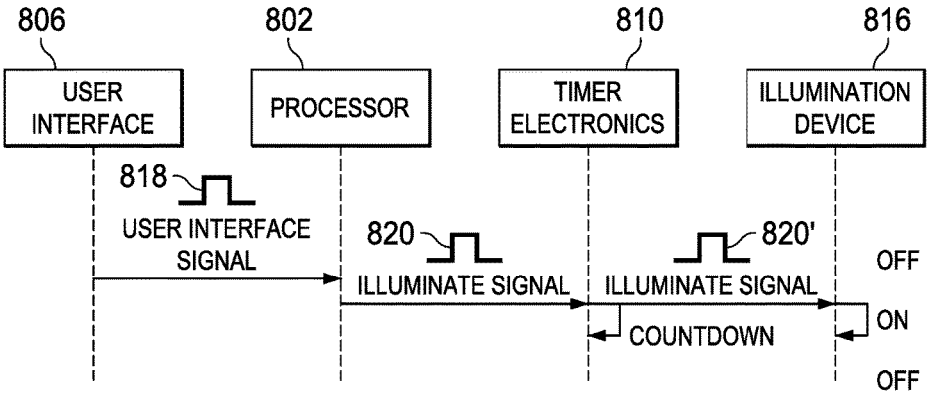
FIG. 9 is a flow diagram of an illustrative process for controlling an illumination device for a backlit panel of a lock-box.

With regard to FIG. 9, a flow diagram of an illustrative process for controlling the illumination device 816 for a backlit panel of a lock-box is shown. In response to a user interacting with the user interface 806, a user interface signal 818 may be communicated to the processor 802. The software 804 may respond to the user interface signal 818 to create an illuminate signal 820. The illuminate signal 820 may be communicated to the timer electronics 810 to initiate the timer, and to cause an illuminate signal 820' to illuminate the illumination device 816 while the timer electronics 810 are driving an ON signal. The timer signal 820' may be high for a certain period of time, such as 15 seconds, to cause the illumination device 816 to stay ON for that period of time. If the user interfaces with the user interface 806 prior to the timer signal 820' turns OFF, then the timer electronics 810 (or software 804 executing on the processor 802) may restart the timer signal 820' for another period of time from the time that the user re-interfaces with the user interface 806. Upon the user entering a lock code via the user interface 806, a lock/unlock signal 822 may be generated by the processor 802 and be communicated to the electromechanical drive assembly 812 to lock the lock-box by engaging the movable bolts 814 to a latch. Upon the same code being entered into the user interface 806, the lock/unlock signal 822 may be generated by the processor 802 and be communicated to the mechanical drive assembly 812 to unlock the lock-box by disengaging the movable bolts 814 from the latch.

The foregoing method descriptions and the process flow diagrams are provided merely as illustrative examples and are not intended to require or imply that the steps of the various embodiments must be performed in the order presented. As will be appreciated by one of skill in the art the steps in the foregoing embodiments may be performed in any order. Words such as "then", "next," etc. are not intended to limit the order of the steps; these words are simply used to guide the reader through the description of the methods. Although process flow diagrams may describe the operations as a sequential process, many of the operations can be performed in parallel or concurrently. In addition, the order of the operations may be re-arranged. A process may correspond to a method, a function, a procedure, a subroutine, a subprogram, etc. When a process corresponds to a function, its termination may correspond to a return of the function to the calling function or the main function.

The various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the principles of the present invention.

Embodiments implemented in computer software may be implemented in software, firmware, middleware, microcode, hardware description languages, or any combination thereof. A code segment or machine-executable instructions may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

The actual software code or specialized control hardware used to implement these systems and methods is not limiting of the invention. Thus, the operation and behavior of the systems and methods were described without reference to the specific software code being understood that software and control hardware can be designed to implement the systems and methods based on the description herein.

When implemented in software, the functions may be stored as one or more instructions or code on a non-transitory computer-readable or processor-readable storage medium. The steps of a method or algorithm disclosed herein may be embodied in a processor-executable software module which may reside on a computer-readable or processor-readable storage medium. A non-transitory computer-readable or processor-readable media includes both computer storage media and tangible storage media that facilitate transfer of a computer program from one place to another. A non-transitory processor-readable storage media may be any available media that may be accessed by a computer. By way of example, and not limitation, such non-transitory processor-readable media may comprise RAM, ROM, EEPROM, CD-ROM or other optical disk storage, magnetic disk storage or other magnetic storage devices, or any other tangible storage medium that may be used to store desired program code in the form of instructions or data structures and that may be accessed by a computer or processor. Disk and disc, as used herein, include compact disc (CD), laser disc, optical disc, digital versatile disc (DVD), floppy disk, and Blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and/or instructions on a non-transitory processor-readable medium and/or computer-readable medium, which may be incorporated into a computer program product.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

What is claimed:

1. A method of manufacturing a lock-box, said method comprising:

assembling a lock-box, including top, bottom, left, right, and rear walls;

assembling a front door, including:

mounting an electromechanical lock assembly to the front door;

electrically connecting a user interface to the electromechanical lock assembly;

securing the user interface to be accessible to a user at the front face of the lock-box;

electrically connecting an illumination device to electronics of the electromechanical lock assembly;

positioning a backlit panel to be removably attached to the front door to form a portion of a front face of the front door, the backlit panel being positioned in front of the illumination device so that information on the backlit panel is illuminated for a user when the illumination device is illuminated;

securing a latch member within the lock-box such that one or more movable bolts of the electromechanical lock assembly are aligned to enter and be removably engaged with the latch member when the front door is a closed position; and rotatably securing the front door to the lock-box to enable the front door to rotate relative to the lock-box such that the one or more movable bolts of the electromechanical lock assembly are aligned to enter and be removably engaged with the latch member when the front door is in the closed position.

2. The method according to claim 1, further comprising forming at least a portion of the front face of the front door, wherein forming the front face includes hydropainting the front door.

3. The method according to claim 1, wherein assembling the front door assembling the front door to be substantially symmetrical to enable the front door to be rotatably mounted from either side of the front door to the member.

4. The method according to claim 1, further comprising securing the illumination device to the backlit panel.

5. The method according to claim 1, further comprising connecting a standoff support member to the front door and behind the backlit panel.

6. The method according to claim 5, further comprising:

attaching a first magnet to the standoff support member; and attaching a second magnet to a rear side of the backlit panel such that the first magnet and the second magnet are attracted to one another so that the backlit panel is magnetically secured to the front panel.

7. The method according to claim 6, further comprising providing a third magnet that is magnetically attracted to the second magnet and has a stronger magnetic bond to the second magnet via the backlit panel than the magnetic bond between the first and second magnets, thereby enabling a user to remove the backlit panel from the front door using the third magnet.

8. The method according to claim 1, further comprising attaching an electrical connector to be in electrical communication with the electromechanical lock assembly to enable a device to be connected to the electrical connector for reprogramming or other data communication purposes, the electrical connector being positioned behind the backlit panel.

9. The method according to claim 1, further comprising disposing a keyed override member of the electromechanical lock assembly behind the backlit panel such that a user has access to a keyhole of the keyed override member with the backlit panel removed from the front door.

10. The method according to claim 1, wherein electrically connecting a user interface includes electrically connecting a user interface inclusive of a keypad and an electronic display configured to display data in response to a user interfacing with the keypad.

11. The method according to claim 10, wherein the electronic display is configured to be backlit.

12. The method according to claim 11, wherein the keypad is configured to be backlit.

13. The method according to claim 1, wherein positioning a backlit panel includes positioning a backlit panel that includes static information disposed thereon for the user to view backlit static information that is illuminated by the illumination device.

14. The method according to claim 13, wherein positioning a backlit panel includes positioning a pair of backlit panels on the front door to form a pair of portions of the front face of the front door.

15. The method according to claim 1, further comprising establishing a timer as part of the electronics, and wherein electrically connecting an illumination device to electronics of the electromechanical lock assembly includes electrically connecting an illumination device that, in response to a user interfacing with the user interface, enables the timer to cause the illumination device to be illuminated for a predetermined amount of time.

* * * * *